United States Patent [19]

Epis

[11] Patent Number: 4,465,108

[45] Date of Patent: Aug. 14, 1984

[54] PLAY TAKING-UP MEANS IN LOOM DOBBY CONTROL UNITS

[75] Inventor: Olivo Epis, Ponte Nossa, Italy

[73] Assignee: Fimtessile Fabbrica Italiana Macchinario Tessile S.p.A., Italy

[21] Appl. No.: 405,369

[22] Filed: Aug. 5, 1982

[30] Foreign Application Priority Data

Aug. 6, 1981 [IT] Italy ..... 23414 A/81

[51] Int. Cl.[3] ..... D03C 1/00; D03C 1/06

[52] U.S. Cl. ..... 139/66 A; 139/71

[58] Field of Search ..... 139/66 A, 66 R, 71, 139/74

[56] References Cited

U.S. PATENT DOCUMENTS

| | | | |
|---|---|---|---|
| 3,665,973 | 5/1952 | Reisdorf | 139/71 |
| 3,851,675 | 12/1974 | Schwarz | 139/71 |

FOREIGN PATENT DOCUMENTS

| | | | |
|---|---|---|---|
| 1535219 | 10/1969 | Fed. Rep. of Germany | 139/71 |
| 2131180 | 9/1972 | Fed. Rep. of Germany | 139/66 R |
| 47-5464 | 2/1972 | Japan | 139/66 R |
| 429615 | 7/1967 | Switzerland | 139/66 A |

*Primary Examiner*—James Kee Chi

*Attorney, Agent, or Firm*—Stevens, Davis, Miller & Mosher

[57] ABSTRACT

Improved means are provided in a loom dobby for taking-up play in the control unit. The surfaces of the fixed and mobile blades which limit the stroke of the rocker arms in this unit are positioned perpendicular to the line joining the points of contact between the dobby hooks and knives to the mean points of contact between said blades and the rocker arms. Moreover, said surfaces are concave in the fixed blades and convex in the mobile blades. The linkage which cause the mobile knives to oscillate are in the form of false articulated parallelograms.

3 Claims, 4 Drawing Figures

PLAY TAKING-UP MEANS IN LOOM DOBBY CONTROL UNITS

BACKGROUND OF THE INVENTION

This invention relates to improvements in loom dobbies, i.e. those apparatus which form the loom shed.

In these machines, it is very important to effectively take-up play in the control unit, this still representing a serious problem for manufactures. The invention confronts and solves this problem by original and particularly effective means.

SUMMARY OF THE INVENTION

The dobby according to the invention is characterised substantially in that in order to improve take-up of the play which arises when the ends of the rocker levers make contract with the relative fixed and mobile stop blades in the dobby control unit, the surfaces of said blades (fixed and mobile respectively) which are designed to make contact with the rocker levers are positioned perpendicular to the line joining the points of contact between the dobby hooks and knives (fixed and mobile respectively) to the mean points of contact between said blades and the rocker levers, said surface having a concave profile in the fixed blades and a convex profile in the mobile blades in the form of circular arcs having their centre at the points of contact between the fixed knives and the hooks and between the mobile knives and the hooks respectively. In addition, at least one of the contact surfaces between the knives and hooks has a small radius convex profile.

Furthermore, the linkages which control the oscillations of the mobile knives about their axes are of false articulated parallelogram configuration.

BRIEF DESCRIPTION OF THE DRAWINGS

The invention is described hereinafter in greater detail by way of example with reference to the accompanying drawing, which represent a practical embodiment thereof, and in which.

DESCRIPTION OF THE PREFERRED EMBODIMENTS

Dobbies are mechanical apparatus by means of which the shed is formed in looms starting from a predetermined fabric design which is transferred in the form of code onto a punched tape, which when read by means of needles controls rocker levers which govern the movement of the heald frames.

Figure 1:
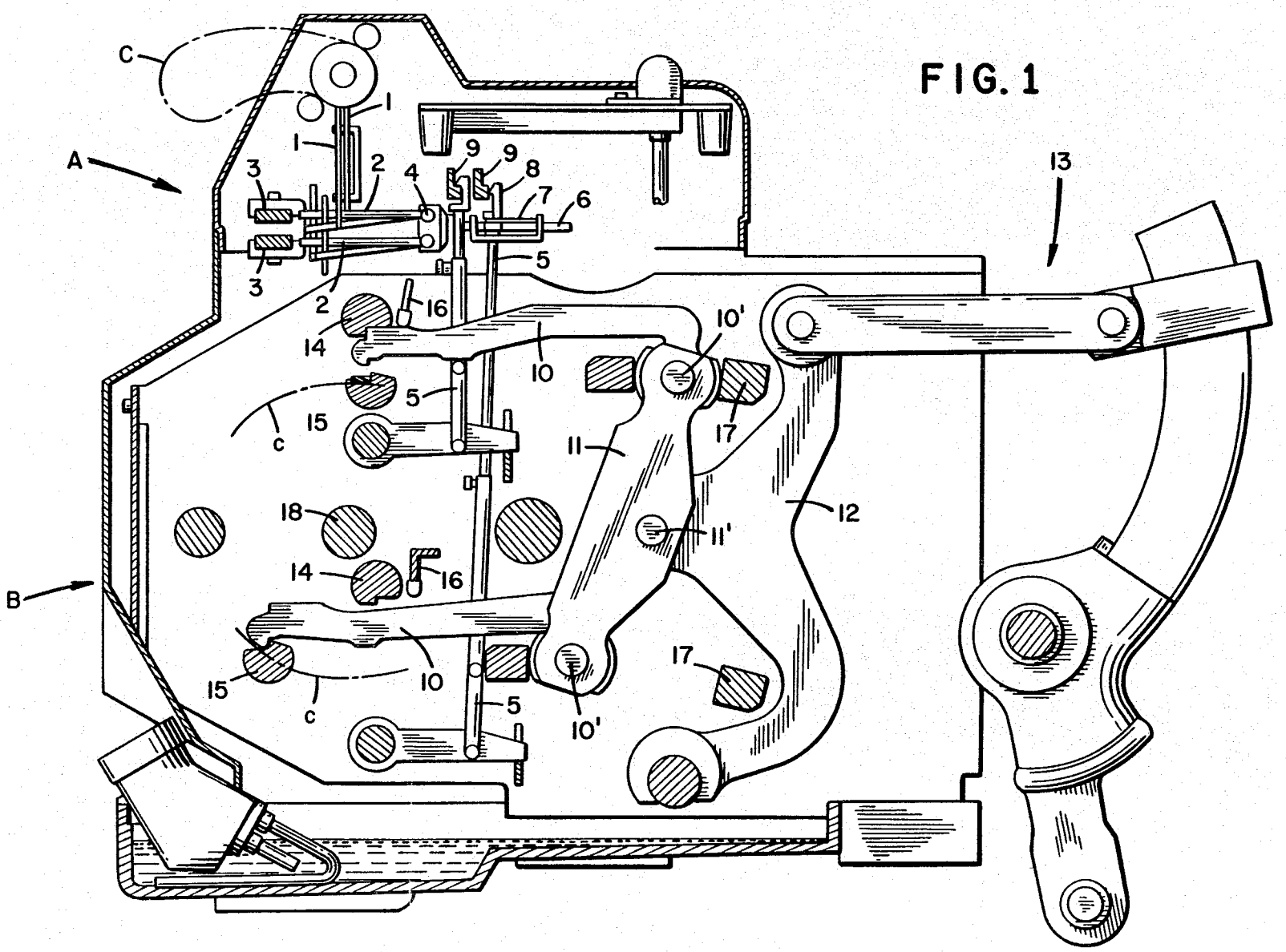
FIG. 1 is a general diagram of a dobby of known type comprising the improvements according to the present invention.

FIG. 1 of the accompanying drawings represents a diagram of a known Hattersley dobby. This diagram shows a reading unit A and a control unit B. The purpose of the reading unit A is to read a punched paper tape C, and comprises reading needles 1, thrust rods 2 oscillating under the control of the needles 1, pressure bars 3 for engaging and thrusting the rods 2 selected by the needles 1, and control rockers 4 controlled by the rods 2. The purpose of the control unit B is to determine the movements of the heald frames under the control of the reading unit A, and comprises vertical control rods 5 controlled by horizontal needles 6 subjected to the action of the rockers 4 and of return springs 7 in order to establish and remove the engagement with lifting blades 9 by way of upper end hook portions 8. It also comprises hooks 10 pivoted at 10' to the ends of rocker levers 11 which in their turn are pivoted at 11' to the centre of transmission levers 12 which operate lever systems 13 for controlling the heald frames. The vertical rods 5 engage with the hooks 10 in order to raise them and lower them in accordance with commands received from the rockers 4 of the reading unit A. The hooks 10 engage with fixed knives 14 and mobile knives 15 in order to control the rocker levers 11. Engagement with the fixed knives 14 occurs when the rods 5 raise the hooks under the control of the lifting blades 9 with which the hook portions 8 cooperate. Engagement with the mobile knives 15 occurs when the rods 5 do not exert positive force on the hooks. The movements impressed by the rocker levers 11 and transmission levers 12 on the lever systems 13 and thus on the heald frames, leading to the formation of the shed, derive from the combination of these engagements and the law governing the movement of the mobile knives 15.

It should be noted that in reality the fixed knives 14 have only their axes fixed, in the sense that they undergo oscillations about this latter for the purpose of facilitating their engagement with the hooks. In contrast, besides undergoing a similar oscillation about their axes (again to facilitate engagement with the hooks), the mobile knives move such that their axes travel along trajectories in the form of circular arcs c.

It should also be noted that the hooks as a rule are lowered under the positive control of hook lowering plates 16 which ensure disengagement of the hooks from the fixed knives and facilitate their engagement with the mobile knives.

Figure 2:
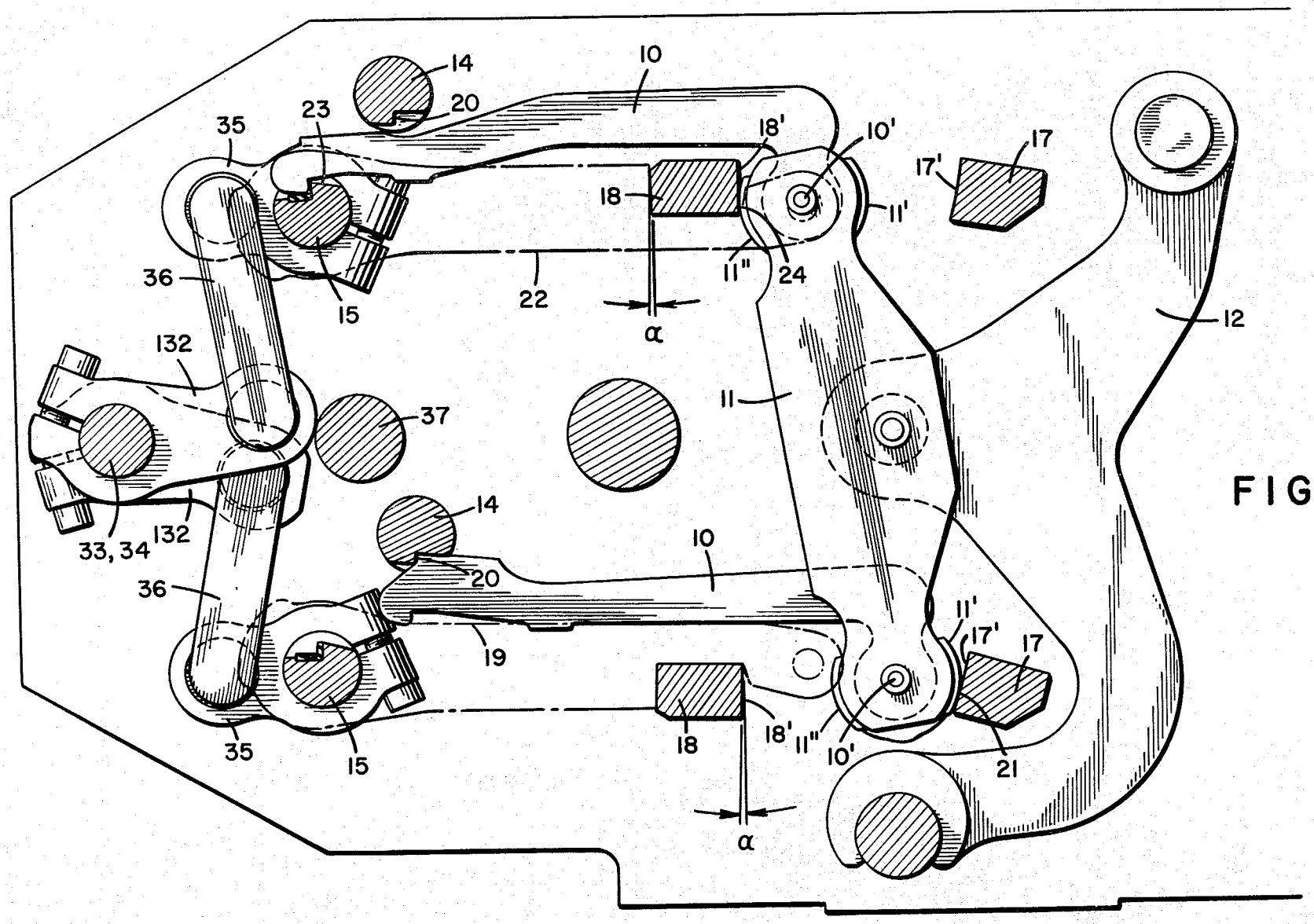
FIG. 2 shows the play take-up means of the invention in greater detail.

In a dobby of this type, the movements of the rocker levers 11 are limited outwards by fixed blades 17 and inwards by mobile blades 18, as clearly illustrated in FIG. 2. This is a control system which is difficult to effect because it is extremely easy for even considerable play to arise as a consequence of the complex trajectories along which the points 10' at which the ends of the hooks 10 are pivoted to the rocker levers 11 move.

In order to prevent or at least effectively limit this play (and thus attain greater constructional precision, improved operation and greatly reduced noise of the dobby), the present invention provides for positioning those surfaces 17' of the fixed blades 17 which engage the ends of the rocker levers 11 perpendicular to the lines 19 joining the points of the contact 20 between the hooks 10 and fixed knives 14 to the mean points of contact 21 between said ends 11' of the rocker levers 11 and said fixed blades 17. Furthermore, according to the invention said surfaces 17' have concave profiles defined by circular arcs having their centre at the point of contact 20 between the hooks 10 and fixed knives 14.

The engagement between the rocker levers 11 and mobile blades 18 also occurs according to the invention by specially positioning those surfaces 18' of the blades which engage the parts 11'' of the rocker levers 10. The surfaces 18 are in fact disposed perpendicular to the lines 22 joining the points of contact 23 between the hooks 10 and mobile blades 15 to the mean points of contact 24 between the ends 11'' of the rocker levers 11 and the mobile blades 18. Furthermore according to the invention, those surfaces 18' of the blades 18 which are designed to make contact with the parts 11'' of the rocker levers 11 have convex profiles defined by circular arcs having their centre at the points of contract 23 between the hooks 10 and mobile knives 15.

The invention also provides for at least one of the contact surfaces between the hooks 10 and knives 14 and 15 to be of convex profile.

Figure 3:
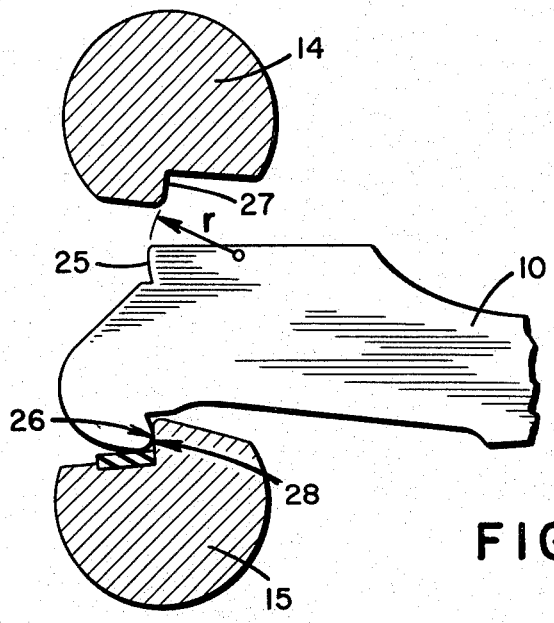
FIGS. 3 and 4 are views to a considerably increased scale of two alternative methods of producing the engagement between the dobby hooks and knives, according to the present invention.

FIG. 3 shows the embodiment in which said convex surface is provided at 25 and 26 on the hooks 10, whereas the knives 14 and 15 have corresponding flat surfaces 27 and 28 for engagement with the hooks. In contrast, FIG. 2 shows the alternative embodiment in which the convex surface is provided at 29 and 30 on the knives 14 and 15, whereas the corresponding surfaces 31 and 32 of the hooks 10 are flat.

Figure 4:
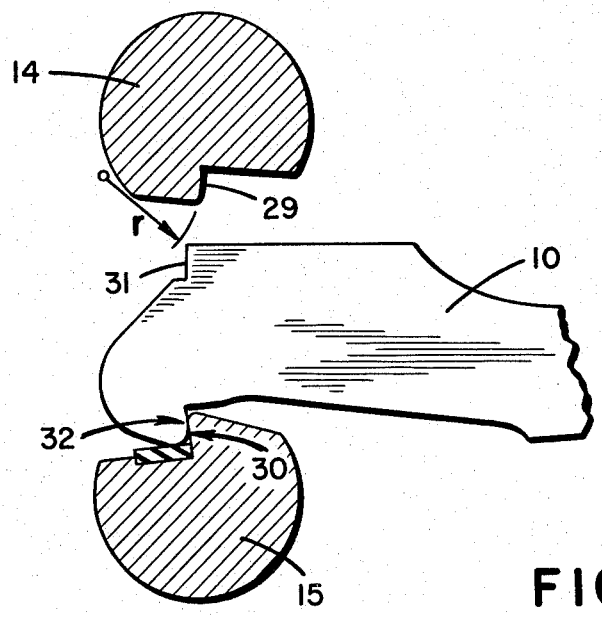

FIGS. 3 and 4 show the small radius r chosen for the surfaces 25, 26, 29 and 30 in order to advantageously attain the objects of the invention.

The left hand side of FIG. 2 shows the articulated parallelogram linkage for causing the mobile knives 15 to undergo oscillation about their axes in order to obtain a small degree of play at the moment of their engagement with or disengagement from the hooks 10, and to eliminate this play when engagement is established.

Said linkages comprise 132 fixed onto abutting aligned shafts 33, 34, levers 35 fixed onto the knives 15 and connecting rods 36 which connect the levers 132 and 35 together. According to the invention, the linkages which form the parallelogram (with its vertices on the axes of the knives 15, on the pivoting points of the connecting rods 36 and on the axis of the pin 37 about which the mobile knives move) have in reality a false parallelogram configuration which without requiring any additional members or devices enables a supplementary movement of the knives to be obtained, leading to a more effective take-up of play during the operating stage than ordinary regular parallelogram linkages would allow. The invention also includes other different embodiments which fall within the scope of the inventive idea.

I claim:

1. A loom dobby, characterised in that in order to improve take-up of the play which arises when the ends of the rocker levers make contact with the relative fixed and mobile stop blades in the dobby control unit, the surfaces of said blades (fixed and mobile respectively) which are designed to make contact with the rocker levers are positioned perpendicular to the line joining the points of contact between the dobby hooks and knives (fixed and mobile respectively) to the mean points of contact between said blades and the rocker levers, said surfaces also having a concave profile in the fixed blades and a convex profile in the mobile blades in the form of circular arcs having their centre at the points of contact between the fixed knives and the hooks and between the mobile knives and the hooks respectively.

2. A dobby as claimed in claim 1, wherein at least one of the contact surfaces between the knives and hooks has a small radius convex profile.

3. A dobby as claimed in claim 1, wherein the linkages which control the oscillations of the mobile knives about their axes are of false articulated parallelogram configuration, which causes the knives to make a supplementary movement as a result of the movement of the linkages.

* * * * *